US010575662B2

(12) United States Patent
Lomax et al.

(10) Patent No.: US 10,575,662 B2
(45) Date of Patent: Mar. 3, 2020

(54) FASTENER FOR MOUNTING A FRAME ONTO A PREVIOUSLY INSTALLED MIRROR

(71) Applicants: Mark Donald Lomax, Hilliard, OH (US); Todd Allen Hite, Gahanna, OH (US); Jeffrey Jay Phipps, Plain City, OH (US)

(72) Inventors: Mark Donald Lomax, Hilliard, OH (US); Todd Allen Hite, Gahanna, OH (US); Jeffrey Jay Phipps, Plain City, OH (US)

( * ) Notice: Subject to any disclaimer, the term of this patent is extended or adjusted under 35 U.S.C. 154(b) by 210 days.

(21) Appl. No.: 15/465,241

(22) Filed: Mar. 21, 2017

(65) Prior Publication Data

US 2017/0265658 A1 Sep. 21, 2017

Related U.S. Application Data

(60) Provisional application No. 62/312,566, filed on Mar. 24, 2016, provisional application No. 62/311,236, filed on Mar. 21, 2016.

(51) Int. Cl.
*A47G 1/16* (2006.01)
*A47G 1/02* (2006.01)

(52) U.S. Cl.
CPC *A47G 1/16* (2013.01); *A47G 1/02* (2013.01)

(58) Field of Classification Search
CPC ... A47G 1/00; A47G 1/16; A47G 1/02; B25H 3/04; E04F 21/1855; E04F 21/185
USPC .... 248/466, 312.1, 339, 304, 215, 489, 301; 211/70.1, 70.6, 94.01, 94.02, 88.01; 40/606.08; 24/546; 224/546, 556, 560, 224/564–566
See application file for complete search history.

(56) References Cited

U.S. PATENT DOCUMENTS 1,520,739 A * 12/1924 Zetlitz ..... A41B 3/04 24/336
1,919,271 A * 7/1933 Cady ..... B60R 9/02 224/546
2,511,083 A * 6/1950 Small ..... E04D 3/365 52/547
D185,897 S * 8/1959 Stark ..... D6/574
3,809,349 A * 5/1974 Baedke ..... B65H 57/26 174/163 R
3,895,605 A * 7/1975 Goldman ..... A01K 63/006 119/245

(Continued)

*Primary Examiner* — Ingrid M Weinhold
(74) *Attorney, Agent, or Firm* — Standley Law Group LLP; Adam J. Smith; Jeffrey S. Standley

(57) ABSTRACT

A fastener for mounting a frame onto a previously installed mirror which does not require screws or adhesives. The fastener has a support panel, a first brace, and a second brace. The support panel functions as the primary support member that is positioned in between the first brace and the second brace. The first brace is a fastener that is mounted onto a first side of the support panel. Additionally, the first brace is used intended to be affixed to the edge of a previously installed mirror Like the first brace, the second brace is a fastener that is mounted onto the support panel. However, the second brace is mounted onto a second side of the support panel and intended to be affixed to a frame. This configuration enables the fastener to function as a mounting device that is positioned in between the frame and the mirror.

8 Claims, 6 Drawing Sheets

(56) References Cited

U.S. PATENT DOCUMENTS

D236,950 S * 9/1975 Goldman et al. ..... D30/106
3,986,649 A * 10/1976 Heimstra ..... B60R 7/043 211/42
4,314,429 A * 2/1982 Casteel ..... E04F 13/0864 33/647
D266,328 S * 9/1982 Fleshman ..... 248/300
4,455,806 A * 6/1984 Rice ..... E04C 3/07 52/404.1
4,458,873 A * 7/1984 Sutherland ..... A47G 1/162 206/499
4,918,893 A * 4/1990 Vandenbroucke .... E04B 1/7666 52/404.2
5,016,404 A * 5/1991 Briggs ..... E04D 13/0722 248/48.1
5,020,755 A * 6/1991 Frankel ..... A47G 23/0225 211/113
5,037,051 A * 8/1991 Moriello ..... B60R 1/12 211/113
5,340,071 A * 8/1994 Fox, II ..... B60J 3/0208 224/312
5,388,738 A * 2/1995 Russell ..... B60R 9/02 224/482
5,664,392 A * 9/1997 Mucha ..... E04B 2/96 248/262
5,876,009 A * 3/1999 Simoncioni, Jr. ..... A47G 25/0614 211/88.01
5,947,433 A * 9/1999 Klein ..... F16M 13/022 248/214
6,032,842 A * 3/2000 Brickner ..... B60R 9/02 224/546
6,079,679 A * 6/2000 Mitchell ..... B25H 3/04 248/229.16
6,237,802 B1 * 5/2001 Douglas ..... B44D 3/123 220/736
6,453,523 B1 * 9/2002 Teidemann ..... B60R 11/00 224/560
6,484,365 B1 * 11/2002 Thompson ..... B60J 3/0204 224/312
6,612,060 B2 * 9/2003 Pearce ..... A47G 1/02 248/467
6,883,671 B2 * 4/2005 Rushing ..... A47F 5/0018 206/736
7,093,403 B2 * 8/2006 Huntting ..... A47G 1/0605 40/768
7,441,382 B2 * 10/2008 Beck ..... E04F 13/0841 52/543
7,533,508 B1 * 5/2009 diGirolamo ..... E04B 2/58 248/300
7,802,709 B1 * 9/2010 Lewis ..... B60R 9/00 224/401
8,225,581 B2 * 7/2012 Strickland ..... E04C 3/07 52/481.1
8,387,321 B2 * 3/2013 diGirolamo ..... E04B 2/58 52/241
8,683,774 B2 * 4/2014 Strickland ..... E04C 3/07 29/897.312
D704,834 S * 5/2014 Bacon ..... D24/128
8,745,959 B2 * 6/2014 Strickland ..... E04C 3/07 52/481.1
9,157,572 B1 * 10/2015 Merideth ..... F24F 13/32
D781,689 S * 3/2017 Darby ..... D8/381
D781,690 S * 3/2017 Darby ..... D8/381
D809,905 S * 2/2018 Gunderson ..... D8/371
9,931,988 B2 * 4/2018 Culleton ..... B60R 5/04
2002/0121066 A1 * 9/2002 Callahan ..... E04B 5/12 52/713
2002/0170216 A1 * 11/2002 Pearce ..... A47G 1/02 40/597
2004/0200940 A1 * 10/2004 Pacheco ..... A47C 7/62 248/301
2008/0006002 A1 * 1/2008 Strickland ..... E04C 3/07 52/843
2009/0249743 A1 * 10/2009 Bodnar ..... E04C 3/09 52/846
2010/0126103 A1 * 5/2010 diGirolamo ..... E04B 2/58 52/655.1
2012/0279162 A1 * 11/2012 Strickland ..... E04C 3/07 52/588.1
2014/0196400 A1 * 7/2014 Bell ..... E04D 13/0725 52/705

* cited by examiner

FASTENER FOR MOUNTING A FRAME ONTO A PREVIOUSLY INSTALLED MIRROR

The current application claims a priority to the U.S. Provisional Patent application Ser. No. 62/311,236 filed on Mar. 21, 2016 and a priority to the U.S. Provisional Patent application Ser. No. 62/312,566 filed on Mar. 24, 2016.

FIELD OF THE INVENTION

The present invention relates generally to fasteners for mirror frames. More particularly, the present invention relates to fasteners for mirror frames which allow a mirror frame to be mounted onto a pre-mounted mirror without the use of adhesives.

BACKGROUND OF THE INVENTION

Homes will sometimes come with previously installed mirrors, and the homeowner will usually want to make the mirror more aesthetically appealing. The homeowner usually adds a personalized touch to the mirror by mounting a frame onto the previously installed mirror. Traditional methods of mounting the frame onto the mirror rely on permanent fasteners such as nails, adhesives, or screws. Because of this reliance on permanent fasteners, traditional mirror frames are difficult to adjust or replace. Additionally, traditional mirror frame fasteners frequently require the previously installed mirror to be removed before the frame can be mounted onto the mirror.

An objective of the present invention is to address this issue by providing fasteners for mirror frames which do not require the mirror to be removed. Additionally, the present invention makes use of fasteners that are not permanent. Thus, allowing the user to switch frames as desired. The present invention makes use of multiple brackets that can be easily removed from or affixed onto the previously installed mirror. The present invention is intended to be perimetrically distributed around the frame and the previously installed mirror. This positioning enables the present invention to be used to mount frames of varying shape and size by distributing the present invention around the perimeter of the frame, the user is able to distribute the weight of the frame around the surface of the previously installed mirror.

DETAIL DESCRIPTIONS OF THE INVENTION

Figure 1:
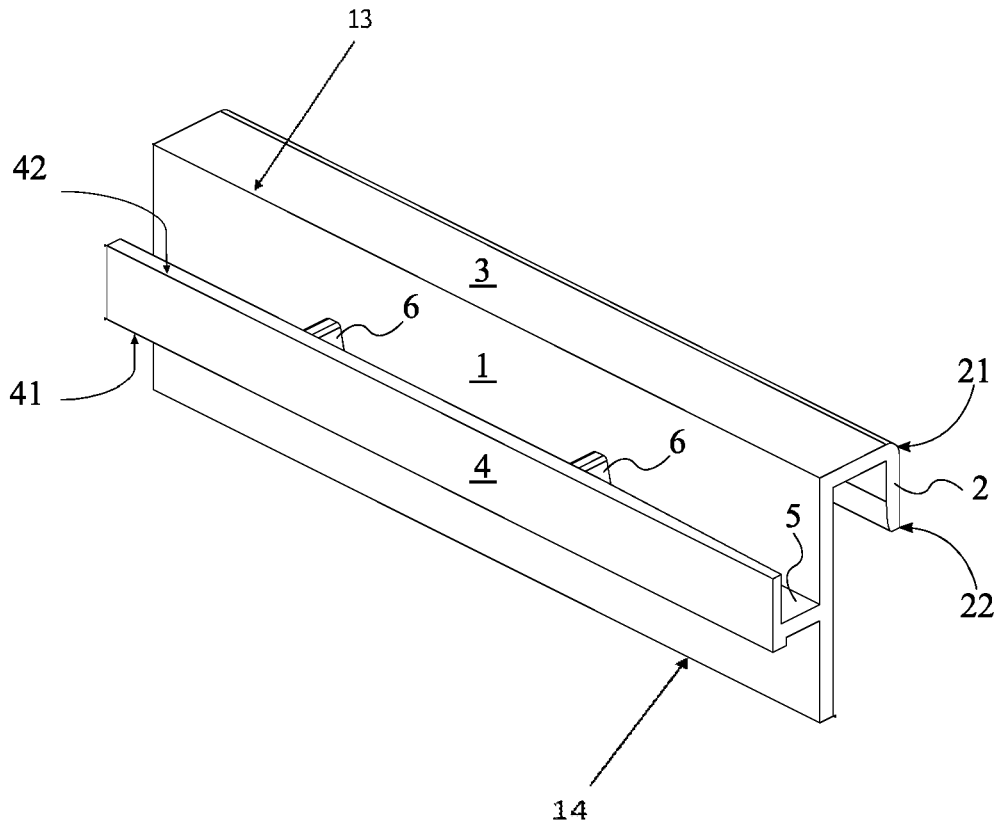
FIG. 1 is a perspective view of the present invention.
Figure 2:
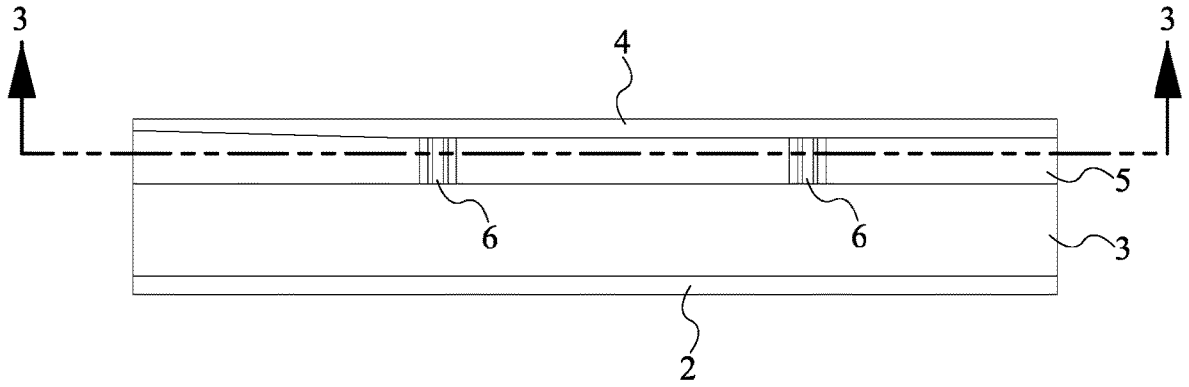
FIG. 2 is a top view of the present invention.
Figure 3:
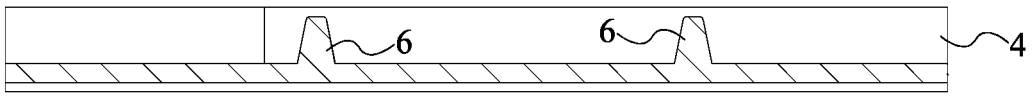
FIG. 3 is a cross sectional view of the present invention taken along line 3-3 in FIG. 2.
Figure 4:
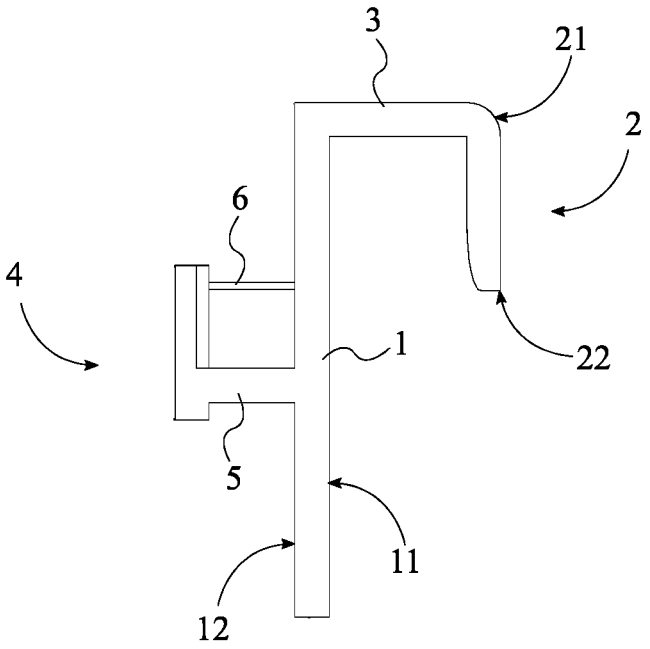
FIG. 4 is a left-side view of the present invention.
Figure 5:
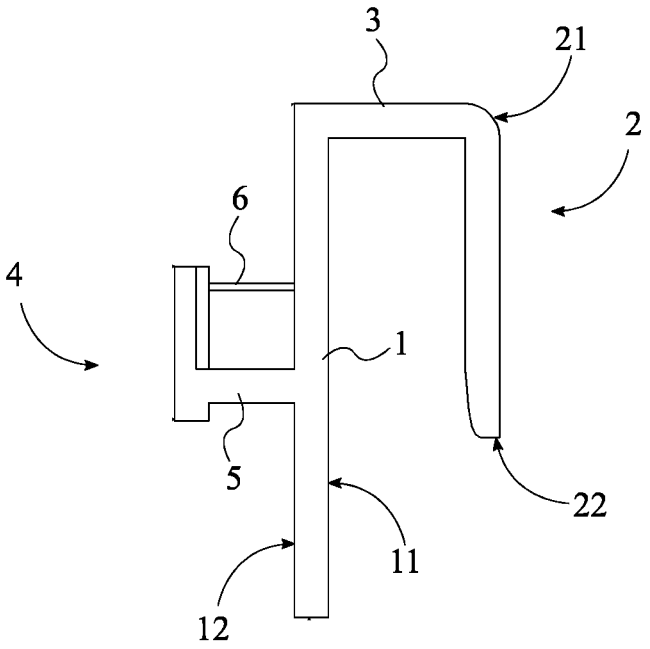
FIG. 5 is a left-side view of the present invention with the first brace extended.
Figure 6:
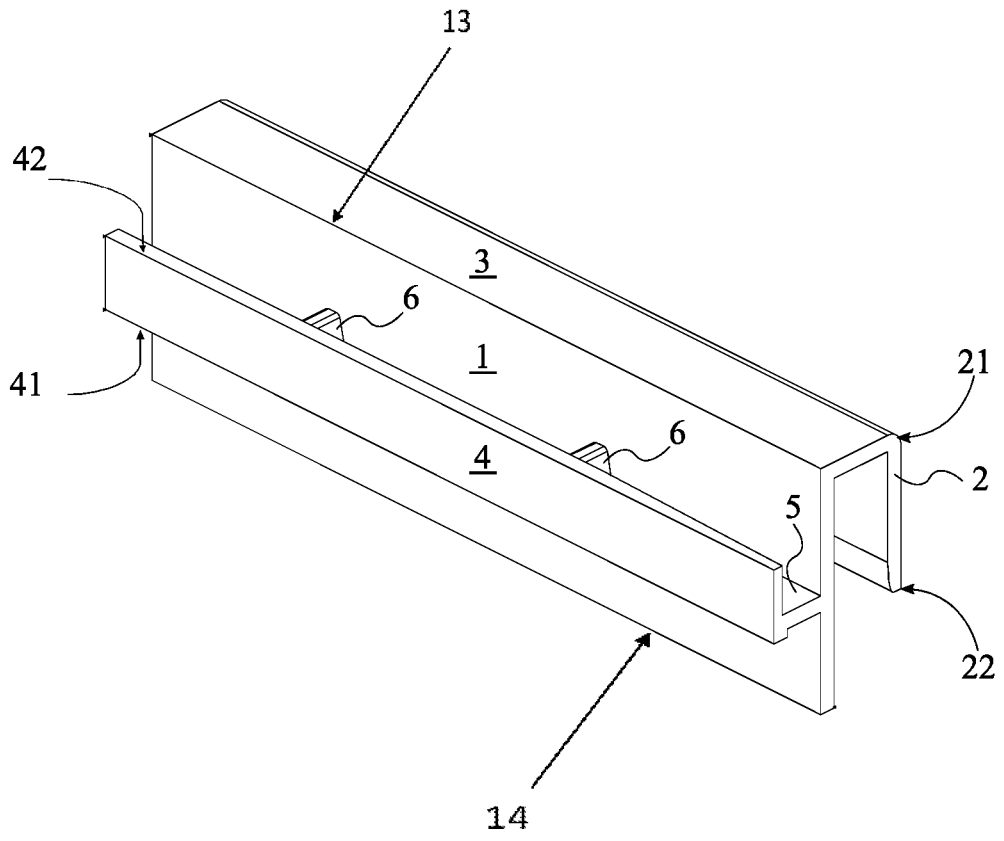
FIG. 6 is a perspective view of the present invention with the first brace extended.

All illustrations of the drawings are for the purpose of describing selected versions of the present invention and are not intended to limit the scope of the present invention.

The present invention, the fastener for mounting a frame onto a previously installed mirror, is an attachment mechanism that enables a user to retrofit a mirror with a desired frame. To accomplish this, the present invention makes use of a fastener that has opposing brackets which connect to the frame and the mirror respectively. The preferred method of use for the present invention is to attach a plurality of fasteners to the frame and then attach the frame to the mirror. By making use of a plurality of fasteners, the user is able to distribute the weight of a frame, and mount uniquely shaped frames onto uniquely shaped mirrors. Furthermore, the use of a plurality of fastener enables the user to attach a frame to a mirror without the use of adhesives, screws, or nails.

The present invention functions as a mounting device by combining the use of multiple braces that are positioned to form brackets which attach to both the mirror and the frame. To accomplish this, the present invention comprises a support panel 1, a first brace 2, and a second brace 4. The support panel 1 is a rigid and flat slab of material that comprises a first face 11, a second face 12, a first lengthwise edge 13, and a second lengthwise edge 14. The first lengthwise edge 13 and the second lengthwise edge 14 are positioned opposite to each other across the support panel 1 so that the support panel 1 can be manufactured in a rectangular or trapezoidal shape. The positioning of the first lengthwise edge 13 and the second lengthwise edge 14 ensures that the first brace 2 will be able to attach the frame around the edge of the mirror. The second brace 4 enables the user to mount the frame in a position which facilitates creating a desired aesthetic.

The general configuration of the aforementioned components allows the present invention to efficiently and effectively make use of a rigid panel as the first brace 2. The first brace 2 is positioned offset and parallel from the first face 11. Consequently, the first brace 2 is used to fasten the present invention onto the mirror by letting the mirror slide between the first brace 2 and the support panel 1. To expound upon this, the first brace 2 is mounted onto the first face 11. As a result, the first brace 2 is configured to attach the present invention onto the edge of a mirror. The first brace 2 can be mounted onto the support panel 1 using components such as, but not limited to, clamps, spring-loaded leverage systems, rigid beams, and bars. Conversely, the second brace 4 is a rigid panel that is positioned offset and parallel from the second face 12. Thus positioned, the second brace 4 is used to fasten the present invention onto the frame by letting the frame slide in between the second brace 4 and the support panel 1. Additionally, the second brace 4 acts as a connection mechanism that is used to affix the frame to the present invention. The second brace 4 is mounted onto the second face 12; the side of the support panel 1 that is opposite to the first brace 2. Furthermore, the first brace 2 and the second brace 4 are positioned offset from each other across the support panel 1. Thus, the present invention is able to receive the mirror and the frame from opposing directions while still being able to use the support panel to evenly distribute the weight of the frame along the edge of the mirror to which the present invention is attached.

The present invention further comprises a first extension web 3 that is a rigid member. The first brace 2 is mounted onto the first face 11 by the first extension web 3. The first extension web is preferably a rigid beam that extends between the first brace 2 and the support panel 1. Preferably, this connection forms a U-shaped bracket that fits over the edge of the mirror. Consequently, the first extension web 3 maintains the first brace 2 in a position that enables the first brace 2 to brace the present invention against the mirror on which the present invention is mounted. In the preferred embodiment of the present invention, the first brace 2 and the first extension web 3 are both elongated strips. These elongated strips run the length of the support panel 1 and are used to distribute the weight of the frame along the support panel 1 and the mirror. Additionally, the first extension web 3 is adjacently and perpendicularly connected to the first face 11. Furthermore, the first brace 2 is mounted onto the first face 11 by the first extension web 3. Thus positioned, the first brace 2, the first extension web 3, and the support panel 1 form a U-shaped bracket that rests on the edge of the mirror on which the present invention is mounted. Finally, the first extension web 3 is positioned along the first lengthwise edge 13. Accordingly, the first extension web 3 and the first brace 2 prevent the frame from rotating about the edge of the mirror. In the preferred embodiment of the present invention, the first brace 2 comprises a free end 22 and a fixed end 21. The first brace 2 is mounted onto the first face 11 by the fixed end 21. Thus positioned, the first brace 2 forms a U-shaped bracket with the first extension web 3 and the support panel 1. This bracket shape enables the present invention to support the weight of the frame. A sagittal cross section of the first brace 2 tapers from the fixed end 21 to the free end 22 so that the first brace 2 can be wedged behind the mirror.

The present invention further comprises a second extension web 5 that is a rigid member, which extends from the support panel 1, opposite to the first extension web 3. Preferably, the second brace 4, the support panel 1, and the second extension web 5 form a U-shaped bracket that fits into the frame. The second brace 4 is mounted onto the second face 12 by the second extension web 5. Consequently, the second extension web 5 maintains the second brace 4 in a position that enables the second brace 4 to brace the present invention against the frame to which it is affixed. In the preferred embodiment of the present invention, the second brace 4 and the second extension web 5 are both elongated strips. These elongated strips run the length of the support panel 1 and are used to distribute the weight of the frame along the support panel 1. Additionally, the second extension web 5 is adjacently and perpendicularly connected to the second face 12. As a result, the second extension web 5 forms the connection member that is able to maintain the second brace 4 in a position that facilitates affixing a frame to the present invention. Furthermore, the second brace 4 is mounted onto the second face 12 by the second extension web 5. Thus positioned, the second brace 4, the second extension web 5, and the support panel 1 form a bracket that can be inserted into the frame to which the present invention is affixed. Finally, the second extension web 5 is positioned in between the first lengthwise edge 13 and the second lengthwise edge 14. Accordingly, the second extension web 5 and the second brace 4 are able to prevent the frame from moving out of an aesthetically pleasing position. This positioning prevents the frame from being easily dislodged.

The present invention further comprises a plurality of connection tabs 6. Each of the plurality of connection tabs 6 is a rigid support beam. Additionally, the plurality of connection tabs 6 is connected in between the second brace 4 and the second face 12 so that the plurality of connection tabs 6 is able to increase the rigidity of the second brace 4. The plurality of connection tabs 6 is distributed along the second brace 4. Consequently, the plurality of connection tabs 6 functions as a stabilization system which distributes the weight of the frame along the second brace 4 and the support panel 1. In the preferred embodiment of the present invention, a transversal cross section for each of the plurality of connection tabs 6 has a trapezoidal shape with a set of rounded vertices. As a result, each of the plurality of connection tabs 6 is designed to fit into the frame and prevent the frame from being laterally displaced, relative to the second brace 4.

In addition to supporting the weight of the frame, the second brace is configured to prevent the frame from becoming dislodged. To that end, the second brace 4 comprises a free edge 42 and a fixed edge 41. The second brace 4 is mounted onto the second face 12 by the fixed edge 41. Thus positioned, the second brace 4 forms a U-shaped bracket with the second extension web 5 and the support panel 1. This bracket shape enables the present invention to support the weight of the frame. The free edge 42 and the fixed edge 41 are positioned opposite to each other across the second brace 4. Accordingly, the free edge 42 functions as a support on which the frame rests while transferring the weight of the frame through the second brace 4 to the second extension web 5, which is connected to the fixed edge 41. The plurality of connection tabs 6 is positioned coincident with the fixed edge 41 so that the plurality of connection tabs 6 is able to further support the second extension web 5 and the second brace 4. The plurality of connection tabs 6 is positioned offset with the free edge 42. Consequently, the free edge 42 forms a lip that extends past the plurality of connection tabs 6 and further secures the frame. The second brace 4 preferably has a lip that extends from the fixed edge 41. This lip further restricts movement of the frame until the present invention is disengaged by the user.

Although the invention has been explained in relation to its preferred embodiment, it is to be understood that many other possible modifications and variations can be made without departing from the spirit and scope of the invention as hereinafter claimed.

What is claimed is:

1. A fastener tar mounting a frame onto a previously installed mirror comprising:

a support panel comprising a first face, a second face, a first lengthwise edge, and a second lengthwise edge, wherein the first lengthwise edge and the second lengthwise edge are positioned on opposite ends of the support panel;

a first brace spaced apart from and extending parallel to the first face, wherein said first brace has a fixed end and a free end located on opposite ends of the first brace;

a second brace spaced apart from and extending parallel to the second face, wherein said second brace has an upper edge and a lower edge located on opposite ends of the second brace and extending substantially parallel to the first and second lengthwise edges;

a first extension web connecting the first brace to the first face, wherein the first extension web extends from the first lengthwise edge of the support panel to the fixed end of the first brace, and wherein the first extension web extends perpendicular to the support panel and the first brace;

a second extension web connecting the second brace to the second face, wherein the second extension web extends perpendicular to the second face and connects to said second brace between said lower edge and said upper edge of said second brace such that the second extension web is positioned offset from the upper and lower edges;

a plurality of connection tabs extending along said second extension web and connecting said support panel to said second brace, wherein the plurality of connection tabs each have a trapezoidal cross-section with rounded vertices;

wherein the first brace and the second brace are located on opposite sides of the support panel.

2. The fastener for mounting a frame onto a previously installed mirror as claimed in claim 1 wherein:

the first brace and the first extension web are each an elongated strip.

3. The fastener for mounting a frame onto a previously installed mirror as claimed in claim 1 wherein:

the first extension web is integrally formed with the support panel.

4. The fastener for mounting a frame onto a previously installed mirror as claimed in claim 1 wherein:

the second brace and the second extension web are each an elongated strip.

5. The fastener for mounting a frame onto a previously installed mirror as claimed in claim 1 wherein:

the free end of first brace is tapered.

6. The fastener for mounting a frame onto a previously installed mirror as claimed in claim 1 wherein:

the first brace, the first extension web, and the support panel are configured to receive the mirror.

7. The fastener for mounting a frame onto a previously installed mirror as claimed in claim 1 wherein:

the second brace is configured to fit within a groove located on the frame.

8. The fastener for mounting a frame onto a previously installed mirror as claimed in claim 1 wherein:

the second extension web extends from said support panel at a location between said first lengthwise edge and said second lengthwise edge.

* * * * *